US010104950B1

(12) United States Patent
Provost et al.

(10) Patent No.: US 10,104,950 B1
(45) Date of Patent: Oct. 23, 2018

(54) SHAVING RAZOR STAND

(71) Applicant: SHAVELOGIC, INC., Dallas, TX (US)

(72) Inventors: Craig A. Provost, Boston, MA (US); Robert A. Wilson, Dallas, TX (US); William E. Tucker, Attleboro, MA (US); John W. Griffin, Moultonborough, NH (US)

(73) Assignee: SHAVELOGIC, INC., Dallas, TX (US)

( * ) Notice: Subject to any disclaimer, the term of this patent is extended or adjusted under 35 U.S.C. 154(b) by 0 days.

(21) Appl. No.: 14/811,529

(22) Filed: Jul. 28, 2015

Related U.S. Application Data

(60) Provisional application No. 62/032,014, filed on Aug. 1, 2014.

(51) Int. Cl.

| | |
|---|---|
| ***A45D 27/29*** | (2006.01) |
| ***A47G 29/08*** | (2006.01) |
| ***A47K 1/09*** | (2006.01) |
| *B65D 75/54* | (2006.01) |
| *A45D 27/22* | (2006.01) |
| *B65D 75/36* | (2006.01) |

(52) U.S. Cl.
CPC ..... *A45D 27/29* (2013.01); *A45D 27/22* (2013.01); *B65D 75/36* (2013.01); *B65D 75/54* (2013.01)

(58) Field of Classification Search
CPC ..... A45D 27/22; A45D 27/29; B65D 75/36; B65D 75/54
USPC ..... 248/311.2, 316.11, 309.1, 314, 682, 127, 248/176.1, 312; 206/208, 228, 352, 471; D6/526; D9/749; 211/70.6
See application file for complete search history.

(56) References Cited

U.S. PATENT DOCUMENTS

| | | | | | |
|---|---|---|---|---|---|
| 3,998,234 | A * | 12/1976 | Stubbmann | A45D 44/18 | 434/263 |
| D370,375 | S * | 6/1996 | Murgida | D6/526 | |
| 5,966,822 | A * | 10/1999 | Coffin | A45D 27/29 | 30/298.4 |
| 6,415,517 | B1 * | 7/2002 | Worrick, III | A45D 27/22 | 206/208 |
| D533,466 | S * | 12/2006 | Wonderley | D9/749 | |
| D540,191 | S * | 4/2007 | Ramm | D9/749 | |
| D576,436 | S * | 9/2008 | Provost | D6/526 | |
| 7,506,854 | B2 * | 3/2009 | Lukan | A45D 27/29 | 248/313 |
| 7,854,320 | B2 * | 12/2010 | Greene | B65D 25/10 | 206/354 |
| D655,206 | S * | 3/2012 | Nottingham | D9/749 | |
| 8,145,821 | B2 * | 3/2012 | Mead | G06F 1/1632 | 361/679.41 |
| 2002/0153863 | A1 * | 10/2002 | Arndt | H02J 7/0027 | 320/114 |
| 2004/0188470 | A1 * | 9/2004 | Hill | A45D 27/29 | 222/192 |

* cited by examiner

*Primary Examiner* — Tan Le
(74) *Attorney, Agent, or Firm* — Leber IP Law; Celia H. Leber

(57) ABSTRACT

Stands for safety shaving razors are disclosed. The stands include a body defining a cavity configured to receive a handle of the razor and a base from which the body extends.

9 Claims, 8 Drawing Sheets

SHAVING RAZOR STAND

RELATED APPLICATIONS

This application claims priority to U.S. Provisional Patent Application No. 62/032,014, filed Aug. 1, 2014, the disclosure of which is hereby incorporated by reference in its entirety.

BACKGROUND

This invention relates generally to shaving and, more particularly, to a shaving razor stand for holding a safety shaving razor in a particular orientation when not in use.

SUMMARY

Generally, this invention relates to a stand apparatus for holding a safety shaving razor in an upright orientation when not in use.

In one aspect, the invention features a shaving razor stand comprising a base and a body having a cavity configured to receive a razor handle, wherein the cavity is defined by a non-circular edge of the body.

Some implementations include one or more of the following features.

The cavity of the razor stand may be defined in part by a generally U-shaped edge of the body, such that the cavity is open on a rear side of the stand. The cavity may be configured to hold the safety shaving razor in a predetermined orientation. The cavity may be configured with razor support elements.

A portion of the cavity may be configured with an elastomeric material. The elastomeric material in the cavity may be configured to interact with a portion of a handle of a safety shaving razor.

The base of the stand may be constructed from elastomeric material. A surface of the base may be configured with gripping elements. The elastomeric material may extend from the base through an opening in the body.

The stand may be configured to have a low center of gravity. The cavity may be configured so that the center of gravity of a shaving razor positioned in the stand will be positioned substantially within the footprint of the base. In some cases, the cavity is configured so that the center of gravity of a shaving razor positioned in the stand will be positioned substantially directly over the center of the base.

DETAILED DESCRIPTION

The present disclosure relates generally to shaving and, more particularly, to a shaving razor stand for holding a shaving razor in a particular orientation when not in use. The stand allows the razor to be stored upright, allowing water to drain from the cartridge during storage.

Figure 1:
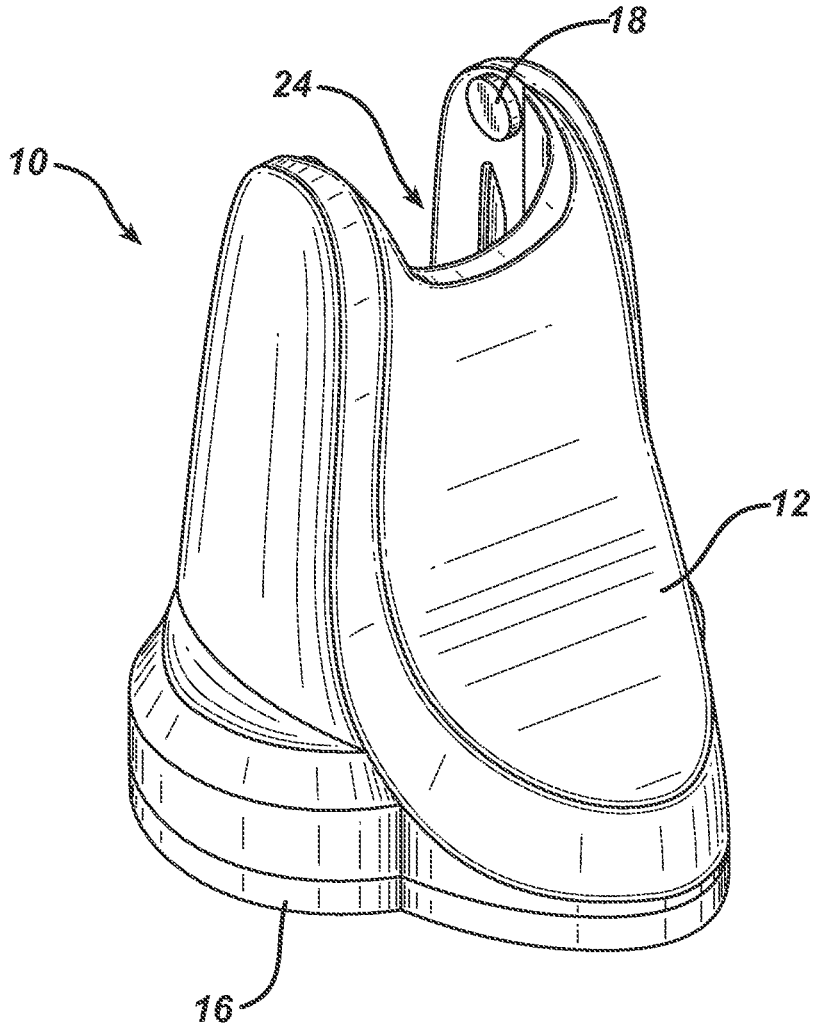
FIG. 1 is a perspective view of a shaving razor stand according to one embodiment of the present invention.
Figure 2:
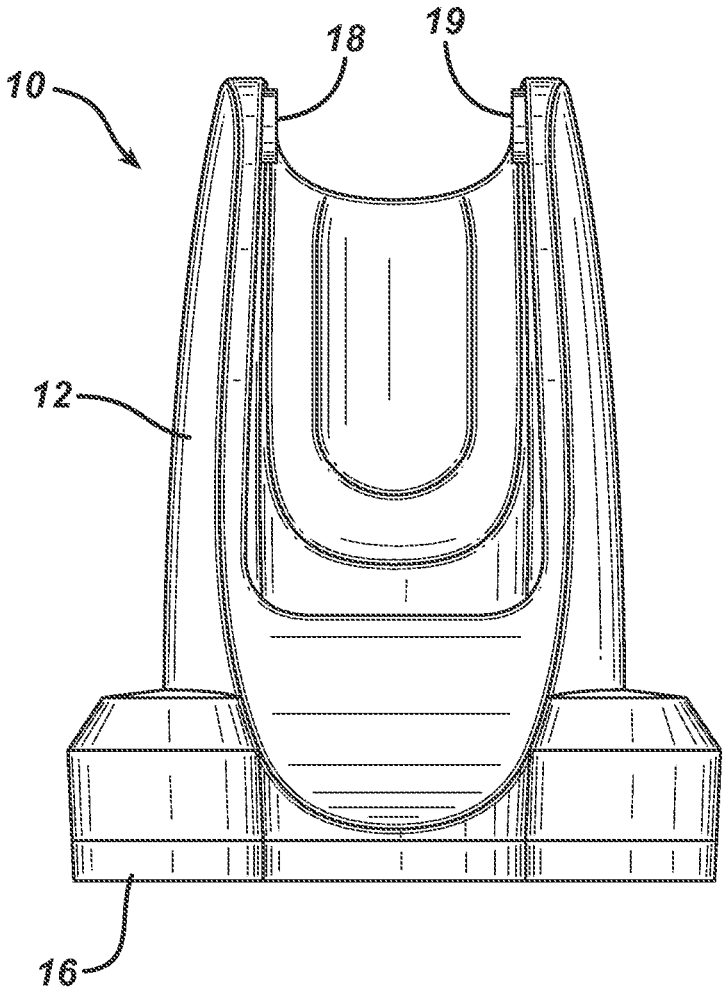
FIG. 2 is a rear plan view of the stand shown in FIG. 1.
Figure 4:
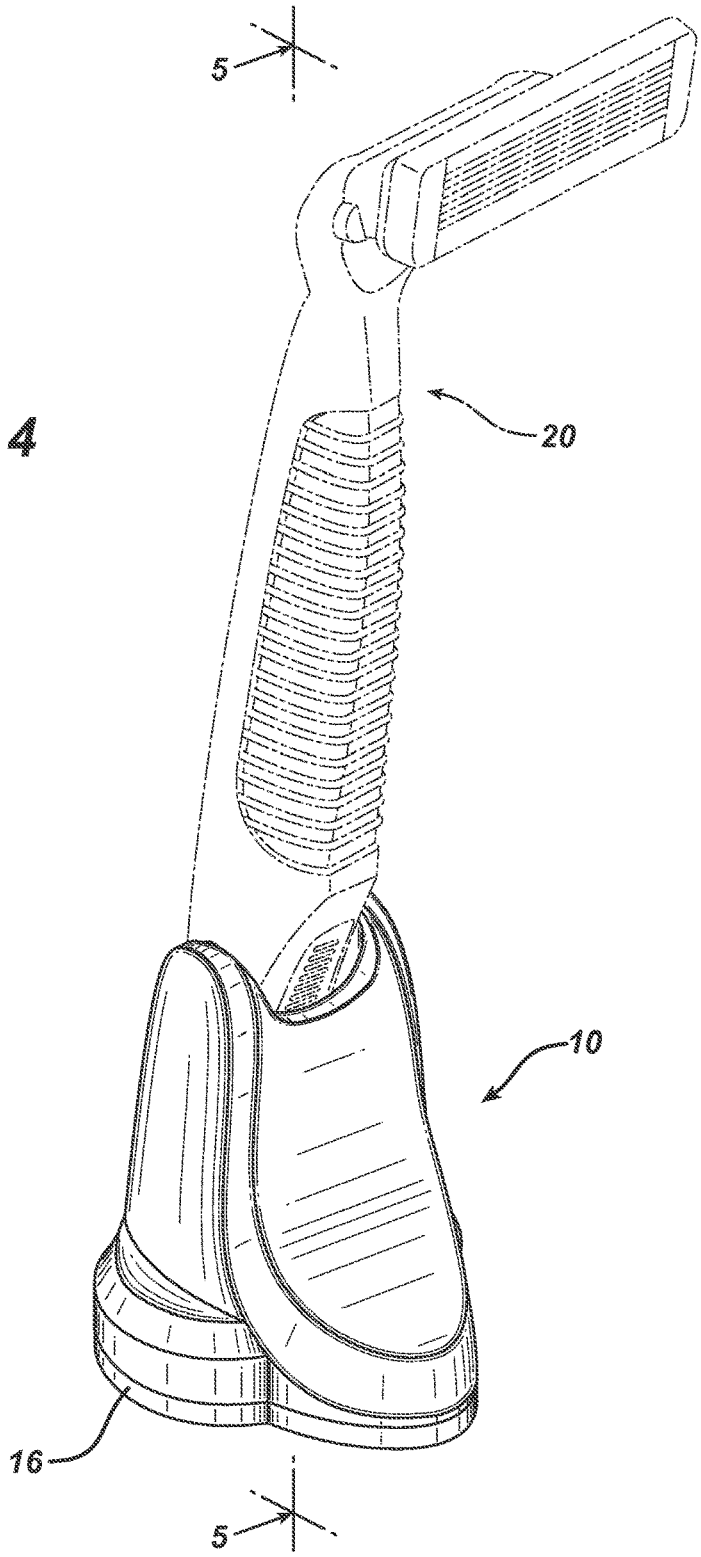
FIG. 4 is a perspective view of the stand with a safety razor assembly shown in phantom.

Referring to FIGS. 1, 2 and 4, a razor stand 10 is configured to hold a safety shaving razor 20 in a desired orientation. The stand 10 is composed of a body 12 and a base 16. The sides of the body 12 define a central cavity 24 that is configured to receive a portion of the handle of a safety shaving razor 20. The cavity 24 of the stand 10 and the portion of the handle to be received are preferably formed to interact in a complementary manner. Base element 16 is configured to substantially cover the lower surface of body 12. Advantageously, base element 16 occupies a small area such that the stand takes up minimal space on a counter or other surface. The small footprint of the base has similar dimensions (width and length) as the long edge of the shaving cartridge (FIG. 4). Preferably, the area of the base is 11.50 square centimeters but could range from generally 11.00 to 12.00 square centimeters.

Figure 2A:
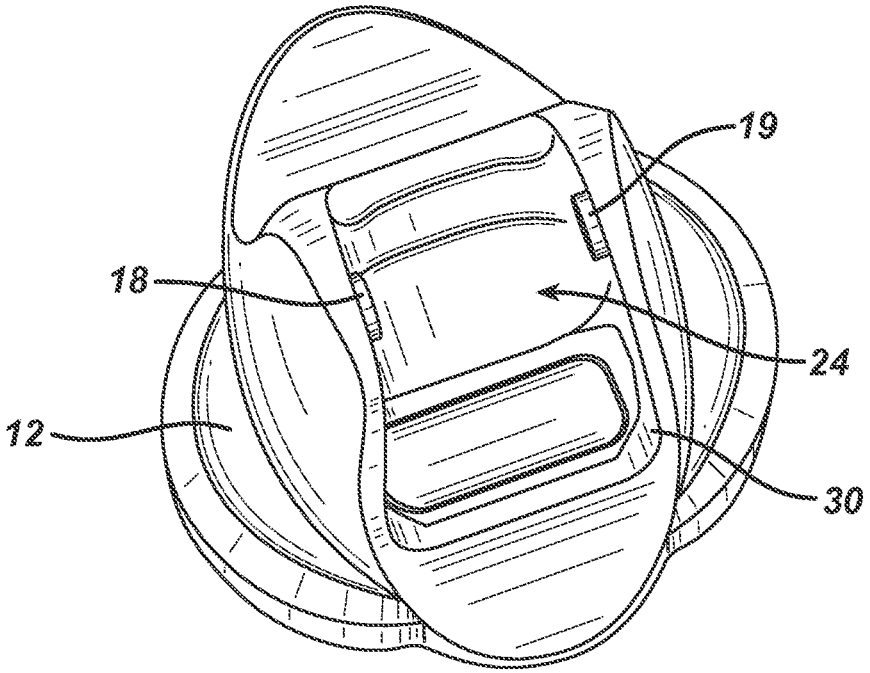
FIG. 2A is a perspective view of the stand.
Figure 7:
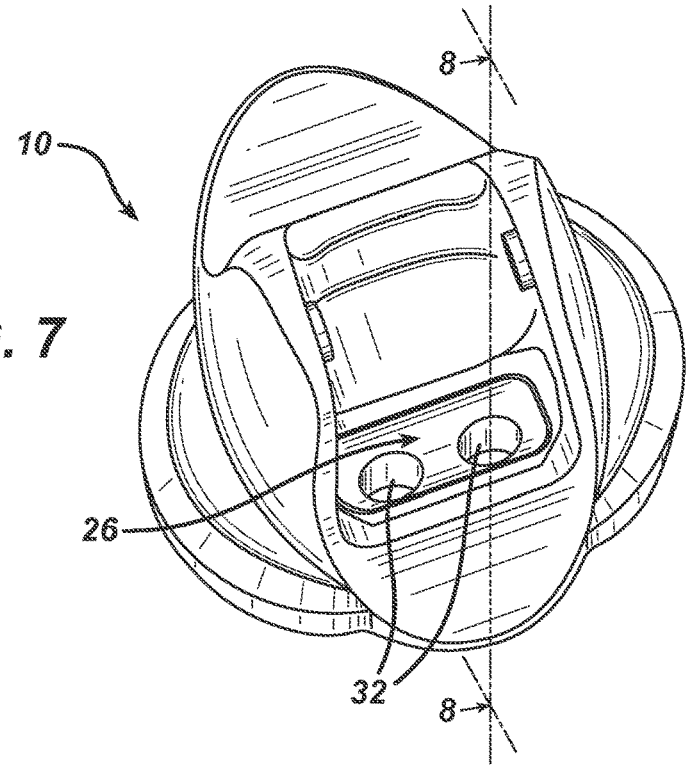
FIG. 7 is a perspective view of the stand according to an alternate embodiment.
Figure 8:
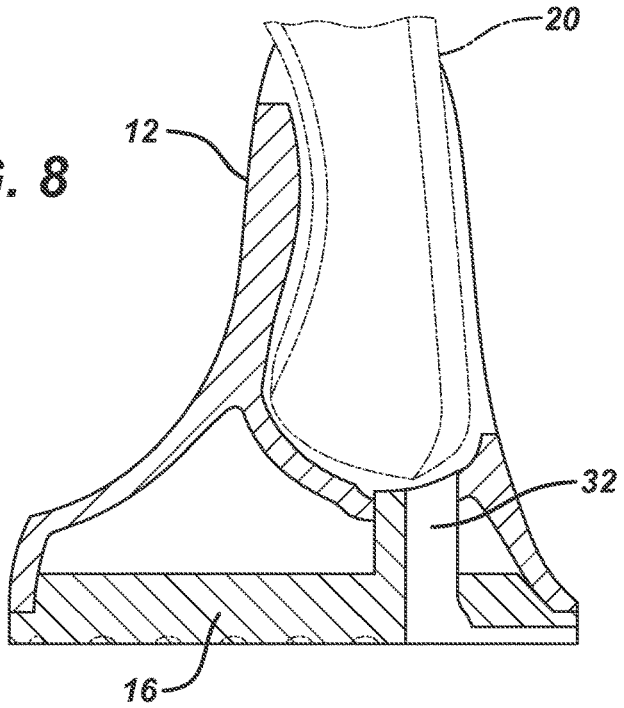
FIG. 8 is a section view of the stand shown in FIG. 7.

The cavity 24 is defined in part by a generally U-shaped rear edge 30 of the body 12 (FIGS. 2A and 6). The U-shape of this edge provides an open area at the back of the stand, which facilitates insertion of the razor into the stand and removal of the razor from the stand. This open configuration of the body also allows moisture that runs down into the cavity 24 from the razor to evaporate. In an alternative embodiment, the stand is also configured with ports 32 that allow water that has collected in the bottom of the cavity 24 to flow out of the stand (FIGS. 7 and 8). Preferably these ports drain out the front of the stand, as shown, providing a relatively short path for the water and allowing the user to easily visualize water draining from the stand and wipe it up if desired.

Referring to FIGS. 1, 2 and 2A, support members 18, 19 are disposed inside cavity 24 near the upper rim. Support members 18, 19 are disposed across from each other and extend from the inner surface of cavity 24. Support members 18, 19 help guide the safety shaving razor into a predetermined orientation with respect to stand 10. The support members are formed during the molding/shaping process when body 12 is created. While shown in cylindrical form, it should be understood that the support elements could take any desired shape so long as they successfully guide and support the handle of the razor when stored in the stand.

Figure 3:
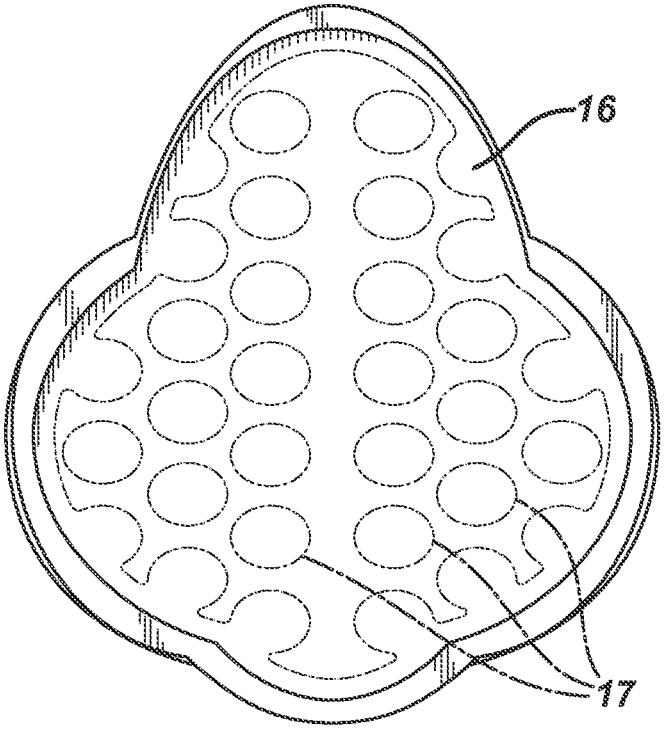
FIG. 3 is a bottom plan view of the stand according to one embodiment.

Referring to FIGS. 1 and 3, base element 16 has a plurality of gripping elements 17 that ensure the stand 10 does not unduly slide or slip when in contact with a smooth surface, e.g. a generally flat portion of a sink or shelf. Preferably, gripping elements 17 are made of an elastomeric material with a Shore A durometer of 20 to 80, e.g. from 40 to 60. In some cases the entire base is made of elastomeric material. Another embodiment of the stand may feature a base that is coated with a soft touch material, e.g. an elastomeric material that applied via an aerosolized spray, which would provide similar anti-slip characteristics.

Figure 5:
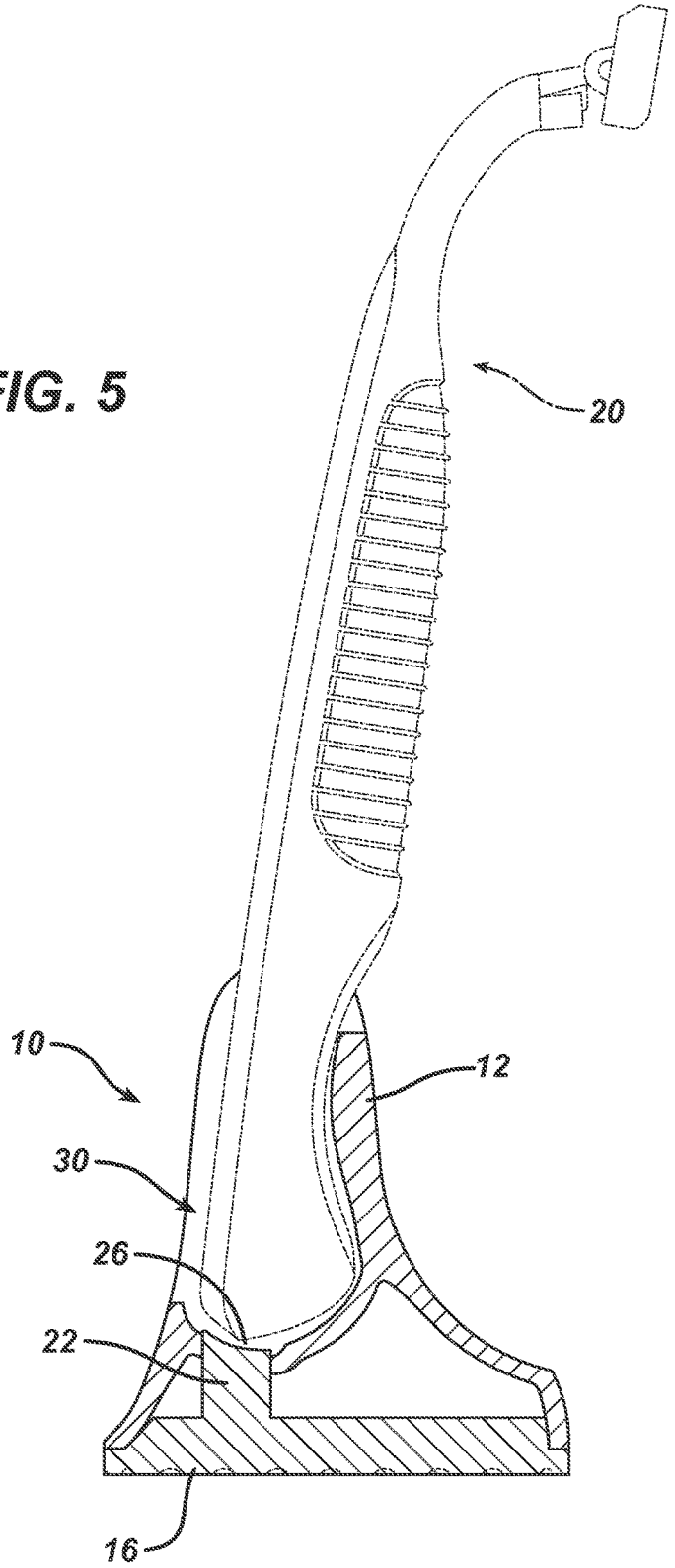
FIG. 5 is a section view of the stand taken along sectional indicator 5 shown in FIG. 4, the shaving razor shown in phantom.

Referring to FIG. 5, portion 22 of the base element 16 extends vertically into the cavity 24 of the body 12. Portion 22 is exposed through an opening 23 in the body 12, and thus provides a soft landing zone 26 for the handle of the razor. As shown in FIG. 2A, the landing zone 26 may be generally oblong or rectangular in shape, and, as shown in FIG. 5, the surface of the landing zone in the short direction may be curved downwards toward the bottom of the cavity, such that the landing zone helps to guide the base of the handle into the cavity.

Base element 16 is configured to be press fit into the body 12. Due to the hollow structure of the body 12 and the shape of the base element 16, an internal cavity 28 is created between body 12 and base element 16. In alternate embodiments, this cavity can be filled by the base element 16, or the body may have a different internal configuration such that the cavity is smaller or absent. Base element 16 may also be designed to be mechanically or chemically attached to the body 12, or a combination thereof. For example, base element 16 may be ultrasonically welded, snap-fit, or glued, to the body 12.

The stand is advantageously designed with a low center of gravity, such that it provides a stable platform to support the safety razor, and so that the stand itself does not tip over if it is bumped when empty. For example, in some implementations the center of gravity of the stand is less than an inch above the surface on which the stand is placed.

Figure 6A:
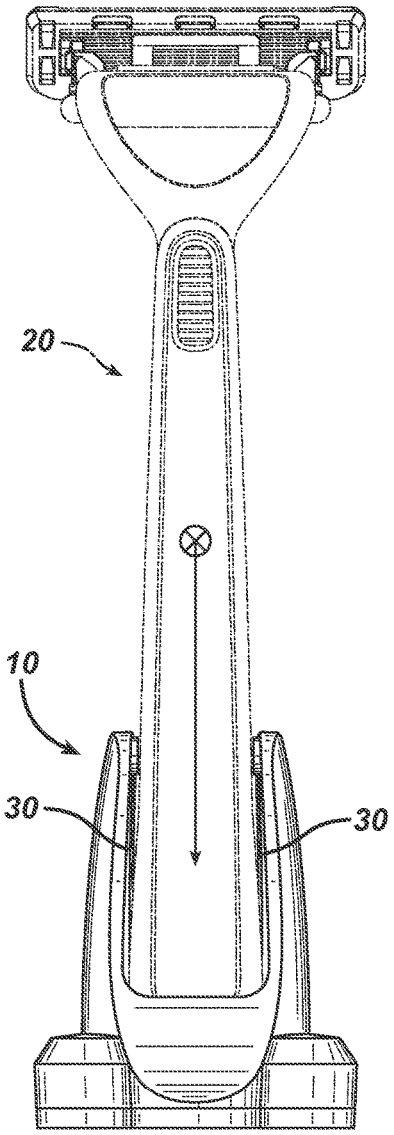
FIG. 6A is a rear plan view of the stand with a safety razor assembly shown in phantom.
Figure 6B:
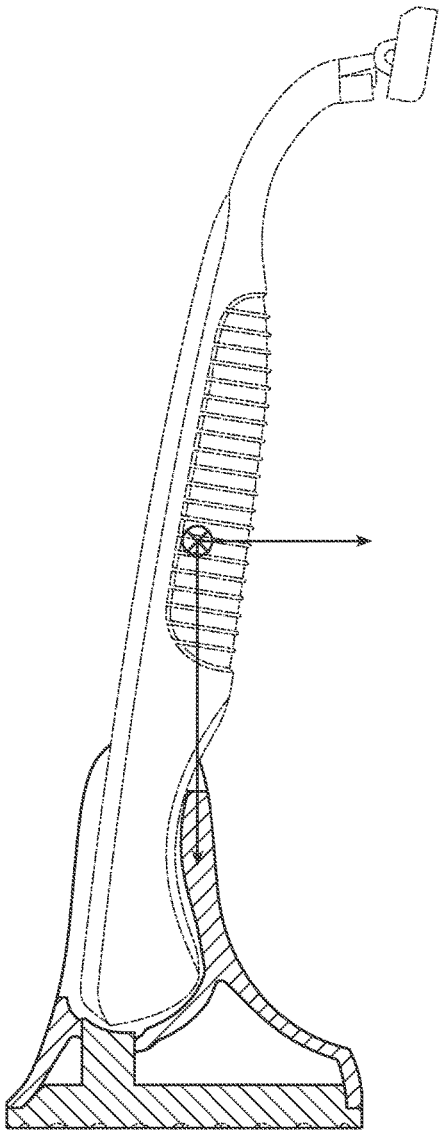
FIG. 6B is a side sectional view of the image shown in FIG. 6A.

Moreover, the stand is designed so that the center of gravity of the razor will be positioned within the footprint and preferably substantially directly over the center of the base element 16, for example, within 0.5 inch of the center, as shown in FIGS. 6A and 6B. Positioning the razor in this manner lends further stability to the stand when in use. This is accomplished by appropriately orienting the safety razor with respect to the stand in concert with the dimensions of the base.

The body 12 of the stand 10 can be made of any suitable material including, for example, polyethylene terephthalate (PET or PETE), high density (HD) PETE, thermoplastic polymer, polypropylene, oriented polypropylene, polyurethane, polystyrene, acrylonitrile butadiene styrene (ABS), polyvinyl chloride (PVC), polytetrafluoroethylene (PTFE), polyester, metal, synthetic rubber, natural rubber, silicone, nylon, polymer, wood, antibacterial or antimicrobial materials, insulating, thermal, other suitable sustainable or biodegradable materials, or any combination thereof. Furthermore, it should be understood that the body could be constructed of material that could be colored or plated to look like metal, wood, or other materials.

OTHER EMBODIMENTS

A number of embodiments have been described. Nevertheless, it will be understood that various modifications may be made without departing from the spirit and scope of the disclosure.

For example, a ferrous magnet or a plurality of ferrous magnets can be implanted in the stand to provide enhanced engagement between the handle of the shaving assembly and the stand. Corresponding metal strips could be affixed, implanted or co-molded to the handle to ensure proper interaction with the magnets when the handle is in the base. The magnetic interaction would provide a retention force so that the shaving assembly would be securely held in the stand, but the retention force would not be so strong as to unduly complicate the removal of the shaving assembly from the stand when desired, e.g. as when initiating shaving.

An alternate embodiment could feature a portal configured in the base of the stand that would collect extraneous water residue and deliver it through the base to the exterior.

In some implementations, the landing zone 26 may be provided by an elastomeric pad or soft touch coating disposed on the lower, inner surface of the body rather than extending from the base through a hole in the body.

Accordingly, other embodiments are within the scope of the following claims.

What is claimed is:

1. A shaving razor stand comprising:

a body having a cavity configured to receive an end of a razor handle opposite to a cartridge-carrying end of the handle and a pair of opposed razor support elements extending outwardly from side walls of the cavity, the support elements being configured to contact the razor handle when the razor handle is positioned in the cavity, and a base disposed at a lower end of the body to support the body on a surface, wherein the cavity is defined by a non-circular edge of the body, and the base comprises an elastomeric material that extends through an opening in the body to define at least a portion of the floor of the cavity that is exposed and positioned for contact with the end of the razor handle.

2. The razor stand of claim 1, wherein the cavity is defined in part by a generally U-shaped edge of the body, such that the cavity is open on a rear side of the stand.

3. The razor stand of claim 1, wherein the base is constructed from elastomeric material.

4. The razor stand of claim 1, wherein the elastomeric material defines a plurality of gripping elements disposed on the lower surface.

5. The razor stand of claim 1, wherein the razor stand has a center of gravity that is less than one inch above a planar lower surface of the base.

6. The razor stand of claim 1, wherein the cavity is configured so that the center of gravity of a shaving razor positioned in the stand will be positioned substantially within the footprint of the base.

7. The razor stand of claim 1, wherein the cavity is configured so that the center of gravity of a shaving razor positioned in the stand will be positioned substantially directly over the center of the base.

8. The razor stand of claim 1 further comprising a drainage port extending from the cavity through the base.

9. The razor stand of claim 8, wherein the drainage port provides fluid communication between the cavity and an outlet on a side wall of the base.

* * * * *